United States Patent [19]

Callaway et al.

[11] 4,423,308

[45] Dec. 27, 1983

[54] THERMALLY CONTROLLABLE HEATING MATTRESS

[75] Inventors: Milton A. Callaway, Jackson, Oreg.; Thomas F. Stutzman, Dunwoody, Ga.

[73] Assignee: Simmons U.S.A. Corporation, Atlanta, Ga.

[21] Appl. No.: 275,960

[22] Filed: Jun. 22, 1981

[51] Int. Cl.[3] ..... H05B 3/36

[52] U.S. Cl. ..... 219/217; 5/421; 5/474; 5/477; 5/480; 128/376; 219/212; 219/527; 219/528

[58] Field of Search ..... 219/211, 212, 217, 527, 219/345, 522, 528, 529, 545, 549; 128/376, 379; 5/337, 351, 352, 343, 345 R, 347, 365, 361 B, 451, 459, 474, 477, 480, 421; 119/1

[56] References Cited

U.S. PATENT DOCUMENTS

| | | | |
|---|---|---|---|
| 1,356,148 | 10/1920 | Hobert | 5/465 |
| 1,371,362 | 3/1921 | Giese | 5/474 |
| 1,881,198 | 10/1932 | Kirk | 219/522 |
| 2,162,021 | 6/1939 | Kidwell | 219/528 X |
| 2,313,864 | 3/1943 | Crise | 219/528 |
| 2,504,352 | 4/1950 | Robell | 5/351 |
| 2,569,138 | 9/1951 | Abbott | 219/212 |
| 2,601,189 | 6/1952 | Wales, Jr. | 219/212 X |
| 2,606,996 | 8/1952 | Westerberg et al. | 219/217 |
| 2,651,788 | 9/1953 | Forwood | 5/352 |
| 2,753,435 | 7/1956 | Jepson | 219/212 X |
| 2,850,617 | 9/1958 | Coldren | 219/212 X |
| 2,980,058 | 4/1961 | Hoffman | 119/1 |
| 3,072,776 | 1/1963 | Quenneville | 219/212 |
| 3,166,768 | 4/1965 | Cunningham | 5/351 |
| 3,287,749 | 11/1966 | Marsico | 5/351 |
| 3,339,409 | 1/1944 | Joy et al. | 219/528 X |
| 3,400,254 | 9/1968 | Takemori | 219/549 |
| 3,417,229 | 12/1968 | Shompke et al. | 219/528 |
| 3,437,792 | 4/1969 | Lauck | 219/212 X |
| 3,443,066 | 5/1969 | Weibel | 219/527 |
| 3,534,417 | 10/1970 | Boyles | 5/345 |
| 3,721,799 | 3/1973 | Carlstrom | 219/212 |
| 3,950,798 | 4/1976 | Borsini | 5/337 |
| 4,074,107 | 2/1978 | Moss | 219/212 |
| 4,162,393 | 6/1979 | Balboui | 219/217 |
| 4,163,896 | 8/1979 | McAvinn et al. | 219/525 |
| 4,234,983 | 11/1980 | Stumpf | 5/477 |
| 4,234,984 | 11/1980 | Stumpf | 5/477 |
| 4,245,363 | 1/1981 | Callaway | 5/451 |

FOREIGN PATENT DOCUMENTS

| | | | |
|---|---|---|---|
| 161097 | 9/1955 | Australia | 219/217 |
| 218315 | 11/1958 | Australia | 219/217 |
| 204144 | 6/1959 | Austria | 219/217 |
| 1181881 | 1/1959 | France | 219/217 |
| 1221058 | 2/1971 | United Kingdom | 219/217 |

*Primary Examiner*—Volodymyr Y. Mayewsky
*Attorney, Agent, or Firm*—Scully, Scott, Murphy and Presser

[57] ABSTRACT

A thermally controlled mattress construction including a mattress body designed to support a person lying on top thereof. A removable pillow top for the mattress body, removably fastened along the peripheral edges, incorporates a thermally controlled liner as an integral but removable part thereof. The liner is removably fastened to the bottom of the top surface by a fastener extending along the lower peripheral edge of the pillow top, and also the pillow top is removably fastened to the mattress body by a fastener extending along its peripheral edge. This arrangement provides for removal of the liner for repair of maintenance or other reasons. In one embodiment, the thermally controlled liner includes an electrical heater, which can incorporate two separately controllable heaters, one for each half side of the mattress. In a second embodiment, the thermally controlled liner includes therein an array of tubing, through which either heated or cooled fluid is pumped to selectively heat or cool the pillow top.

5 Claims, 10 Drawing Figures

THERMALLY CONTROLLABLE HEATING MATTRESS

BACKGROUND OF THE INVENTION

1. Field of the Invention

The present invention relates generally to a thermally controlled pillow top for a mattress, and more particulary pertains to a thermally controllable pillow top for a mattress in which a thermally controlled element such as an electrical heater is removably fastened to the bottom surface of the pillow top.

2. Discussion of the Prior Art

The use of electrically heated blankets, comforters and other coverings is well known in the art. Many of these known articles, however, have inherent disadvantages which prevent their use in an efficient and economical manner.

In the case of electrically heated mattresses, the electrical heating element is generally laid as a pad on top of the mattress, and the user, when reclining on the mattress, is in the path of warm air rising upwardly from the heating element within the mattress. However, an electrically heated mattress having a heating element incorporated into its construction generally suffers from a major disadvantage in that if the heating element fails for some reason, repair of the element is for most practical purposes impossible. Carlstrom U.S. Pat. No. 3,721,799, for instance, discloses an electrically heated fabric material having electrical heating elements woven therein which is designed for use in blankets or mattresses and would suffer from the aforementioned disadvantage.

Moreover, a mattress is a complex supporting structure, of elastic and plastic deformability, subject to both static and dynamic stresses. It must be elastic in order to allow a determined amount of depression in response to a load, while not substantially altering the axis of the load, i.e. of the human body lying down. The mattress also has further functions such as that of allowing transpiration of the supported body, and it must also have suitable thermal characteristics. All of these factors must be taken into account in the design of a climate controlled mattress, making the construction of a suitable heated or cooled mattress a rather complex project.

Abbott U.S. Pat. No. 2,569,138 provides an electrically heated mattress pad designed to alleviate some of the above-mentioned difficulties. The disclosed arrangement provides a mattress pad embodying therein an electrical heating element. The pad is adapted to be placed over the top of a conventional mattress such that it is removably placed thereon to obtain the advantages of an electrically heated mattress, while permitting rearrangement and reversing of the mattress and also removal of the mattress pad itself for cleaning or washing.

Moss U.S. Pat. No. 4,074,107 is also of interest in disclosing an electrically heated quilt designed to be placed about the top surface, sides and bottom edges of a mattress.

Unfortunately, the prior art does not provide a thermally controlled mattress having the thermally adjusting element as an integral part thereof which provides all of the benefits of thermally control while also allowing for convenient removal of the adjusting element for maintenance or replacement.

SUMMARY OF THE INVENTION

Accordingly, it is a primary object of the present invention to provide a thermally controlled pillow top for a mattress having a thermally adjusting component as an integral part of its construction while also providing for convenient removal thereof for maintenance or replacement.

A further object of the subject invention is the provision of a pillow top of the aforementioned type for providing a controllable environment in which energy savings are affected by allowing an energy conserving thermostat setting in the home during sleeping hours. Moreover, the present invention also provides many of the therapeutic benefits of heating or cooling elements for various parts of the body.

In accordance with a preferred embodiment, a climate controlled pillow top for a mattress is provided in which an underlying mattress body is designed to support a person lying on top thereof. A pillow top surface for the mattress body is removably fastened thereto along the peripheral edges. The removable pillow top incorporates a climate adjusting component as an integral but removable part thereof to allow the top surface of the mattress to be selectively heated or cooled. In one preferred embodiment, an electrical heater comprises an electrical heating pad liner which is removably fastened to the bottom of the removable pillow top by a fastener extending along the lower peripheral edge of the pillow top, and further the top is removably fastened to the mattress body by a fastener extending around its peripheral edge. The removable pillow top may be a quilted mattress top liner or any other suitable type, and also the electrical heater can incorporate two separately controllable heaters, one for each half side of the mattress.

In a second preferred embodiment of the present invention, the climate adjusting component includes an array of tubing in a lining through which a fluid, such as air or water, is circulated. In these embodiments the fluid is preferably heated or cooled by an external unit, although the fluid might also be heated or cooled by a unit constructed as an integral part of the mattress. These embodiments also have an advantage in that in warm weather the circulated fluid may be cooled, thus presenting a very versatile climate controlled mattress.

An important consideration in mattress construction lies in the provision of a mattress which affords a maximum degree of comfort to the individual user, in effect, with respect to the firmness obtained through the internal construction thereof, particularly with regard to the center portion of the mattress which is subjected to extensive usage. Inasmuch as different users often prefer mattresses having a wide variety of consistencies and degrees of firmness, it is readily understandable that, in order to be able to satisfy a broad range of consumer demands, this would necessitate the manufacture of many types of mattresses affording the consumer a wide choice of selection. Obviously this presents problems in the economy of manufacturing and stocking of a large supply of mattresses having different characteristics and firmness in order to be able to meet most consumer needs.

In order to ameliorate these problems, there has been developed the concept of providing a basic mattress frame or perimeter construction which, in combination with a replaceable and interchangeable core portion forming the major supporting area of the mattress, facilitating a rather inexpensive manufacture of the mattress while imparting a versatility in construction and adaptability to consumer needs not heretofore encountered in the prior art.

An important aspect of a particular embodiment of the present invention resides in the provision of a removable, climate controllable pillow top with a mattress which has an insertable core which facilitates an adaptability for showroom demonstration and emphasizes the versatility thereof to potential customers. In effect, the insertable and interchangeable core imparts a customized property to the mattress without the need for expensive modifications to the basic mattress construction. Thus, a wide range of customer needs and individual tastes can be demonstrated in a simple and inexpensive manner through a simple interchange of the core portion of the mattress in a standardized outer perimeter frame structure.

Another feature of the inventive mattress arrangement consists of its ready adaptability to field servicing amd replacement of worn or damaged mattress components without the need to return the mattress to a factory or the requirement for skilled servicing personnel.

In addition to the foregoing, the insertable core allows for the insertion therebeneath of an orthopedic bed board into the perimeter support structure by either the user or by personnel in the retail outlet selling or servicing the mattress arrangement. This, of course, again enlarges the scope of application of the mattress arrangement to a wider public and enhances the saleability of the product.

Yet another feature of a particular disclosed embodiment of the present invention comprises the provision of a mattress arrangement as described herein which is adapted for showroom demonstrations of numerous variations thereof so as to apprise potential customers of the versatility of the arrangement.

BRIEF DESCRIPTION OF THE DRAWINGS

The foregoing objects and advantages of the present invention for a thermally controllable pillow top for a mattress may be readily understood by one skilled in the art with reference being had to the following detailed description of several preferred embodiments thereof, taken in conjunction with the accompanying drawings wherein like elements are designated by identical reference numerals throughout the several drawings, and in which.

DETAILED DESCRIPTION OF THE DRAWINGS

Figure 1:
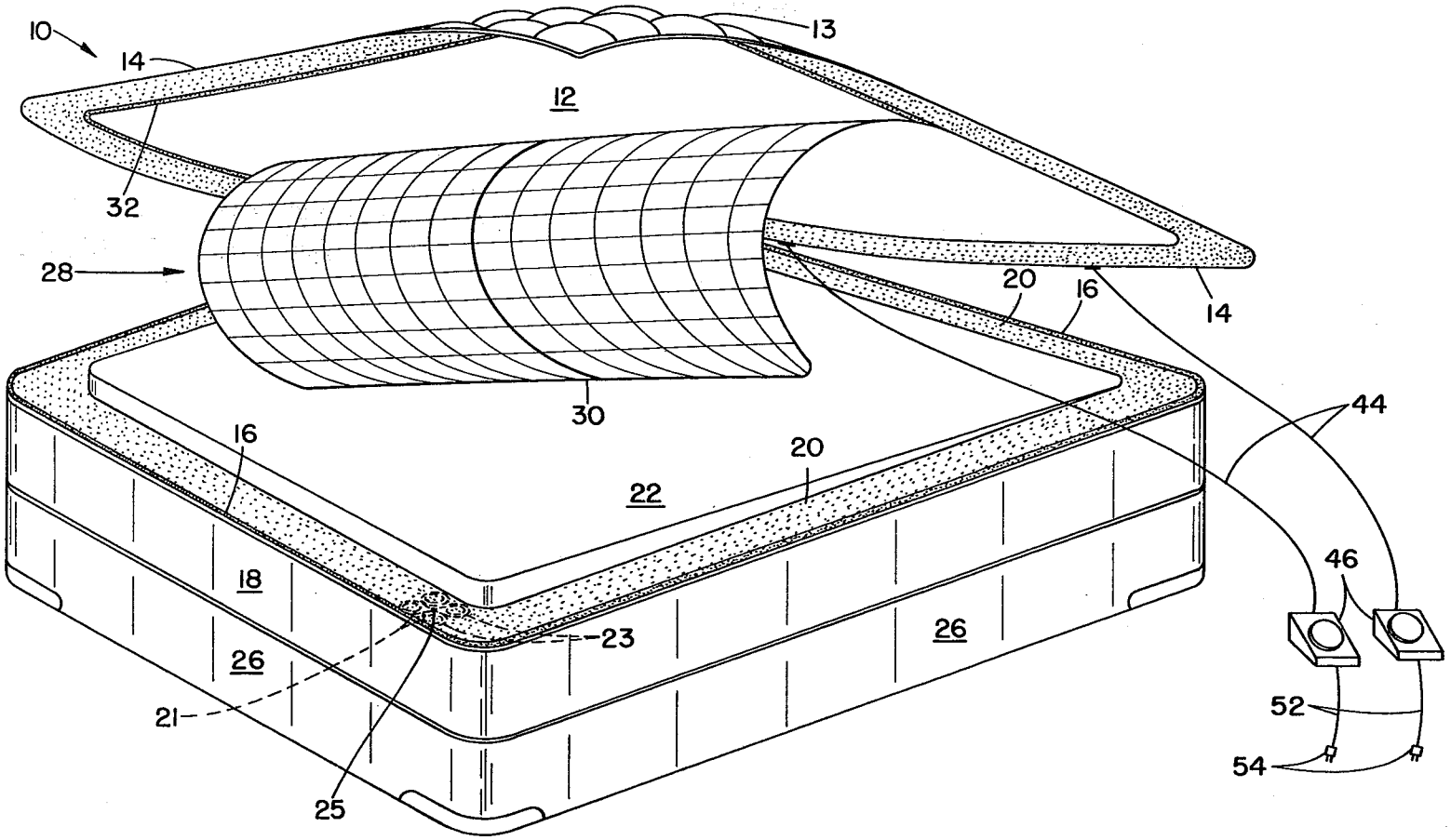
FIG. 1 is a perspective view of an exemplary embodiment of a mattresss having a removable pillow top cover with a removable electrical heating pad therein which is constructed pursuant to the teachings of the present invention.
Figure 2:
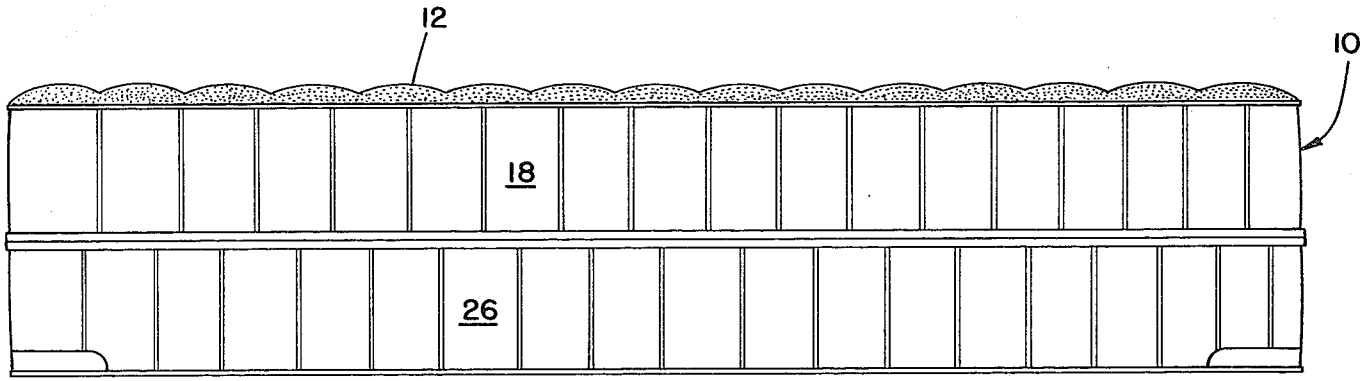
FIG. 2 illustrates an elevational view of the embodiment of FIG. 1 in a completely assembled state.
Figure 4:
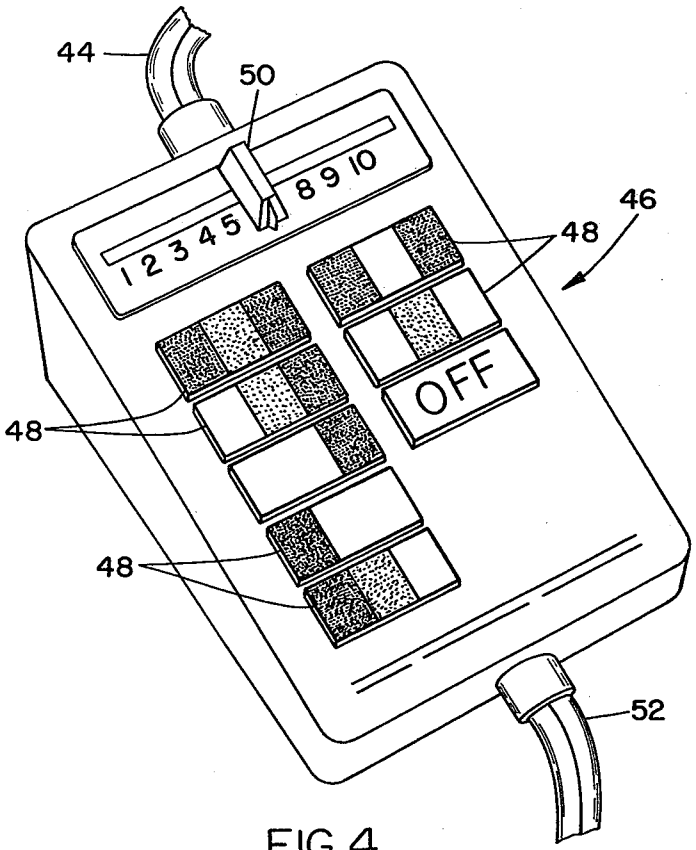
FIG. 4 is a schematic illustration of an electrical heat control unit for controlling the heat generated in an electrically heated mattress constructed pursuant to the teachings herein.

Referring to the drawings in detail, FIG. 1 is a perspective view of an exemplary embodiment of a mattress 10 constructed with a removable pillow top cover 12. Pillow top 12 may be a suitably quilted cloth top 13 which has a fastener track 14 provided around its rectangular peripheral edge. A corresponding fastener track 16 is provided around the rectangular peripheral edge of a mattress body 18, such that the pillow top and mattress body 18 may be fastened together or separated from each other. The fasteners are preferably zippers of the type that they are concealed, as by a flap, after closure thereof. In other embodiments fasteners 14 and 16 can be Velcro ® type fasteners.

Figure 6:
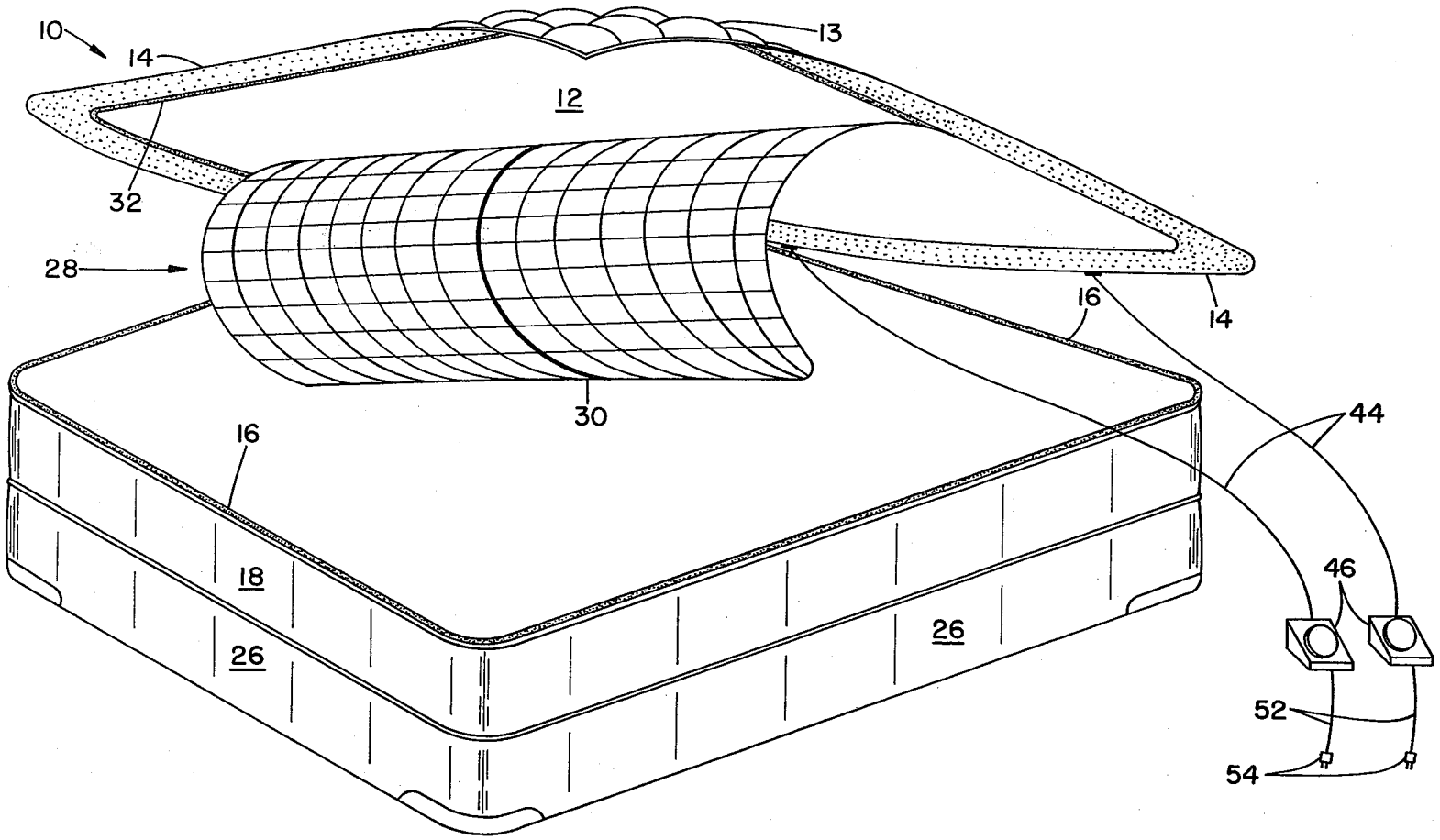
FIG. 6 illustrates a further exemplary embodiment of the present invention similar in concept to that shown in FIG. 1, but wherein the removable pillow top is utilized in combination with a conventional mattress.

Mattress body 18 may be a traditional type of mattress having one unitary body as illustrated in FIG. 6, but preferably is constructed of two separable components, an outer peripheral section 20 and a removable core unit 22 which is illustrated in FIG. 1 in a partially inserted position for clarity of detail. With this type of construction, the core unit 22 is replaceable, and may be selected at the time of purchase to be soft, firm, extra firm, etc. Alternatively, the core unit may take different types of construction such as for instance a foam rubber construction or a traditional coil spring construction or a fluid filled construction, or variations and combinations on these different types of construction. A pillow top 12 may also be removably fastened to the bottom of mattress body 18, such that a very flexible, interchangeable arrangement of components is presented thereby. The aforementioned flexible type of mattress construction is covered in copending patent application entitled Bed Mattress, U.S. Application Ser. No. 275,956, filed June 22, 1981, now abandoned, commonly assigned herewith. The mattress 10 rests upon a box spring 26 which may have a traditional type of construction.

The outer frame structure 20 may include encompassing upper and lower border wires consisting of inner and outer wires of round, rectangular or any suitable cross-section which are interconnected to a plurality of coil springs extending about the perimeter of the frame structure. The wires and the coil springs form a generally rigid but resiliently yieldable rectangular mattress frame adapated to comfortably support the weight of a person sitting on the edge of the mattress while concurrently maintaining the shape of the mattress. The wires and coil springs may be formed of metal or of a suitable plastic material such as vinyl. The outer frame structure 20 may be covered on all exposed sides thereof with a suitable covering material such as mattress ticking, or a tufted or quilted mattress pillow material which imparts a soft and luxurious look and feel to the mattress. The mattress covering material may, if desired, consist of an either woven or non-woven breathable fabric, such as synthetic fiber material, cotton or combinations of materials which afford the necessary comfort to a user resting or sleeping on the mattress. Moreover, the mattress arrangement may incorporate a mattress pillow top filled with down or other soft foam-like material which will impart a particularly full and luxurient look and texture to the mattress.

In lieu of the inner and outer border wires and the coil springs, the peripheral frame structure 20 may be constructed of pocketed springs, or may be constituted of a plastic or foamed material. Thus, for instance, the peripheral frame structure 12 may consist of a rectangular or so-called "square" array or arrangements of non-nested coil springs 21 in individual pockets 23 in which adjacent pocketed strips of springs are interconnected at 25 by connecting the fabric strips together between springs, for example, by stitching, seaming or ultrasonic welding of the seams of the material or of the fabric strips, the material preferably being non-woven thermoplastic fiber material, rather than by connecting of the springs so that the interconnection of any spring with its adjacent springs is accomplished in the same manner, in essence, through the material in which the spring is housed. This type of pocketed coil spring structure eliminates the tendency exhibited by nested assemblies of pocketed coil springs to trap an individual coil or coils in partially compressed condition. A structure of this nature is disclosed in Stumpf U.S. Pat. No. 4,234,984 assigned to the Simmons Company, the disclosure of which is incorporated herein by reference.

Figure 7:
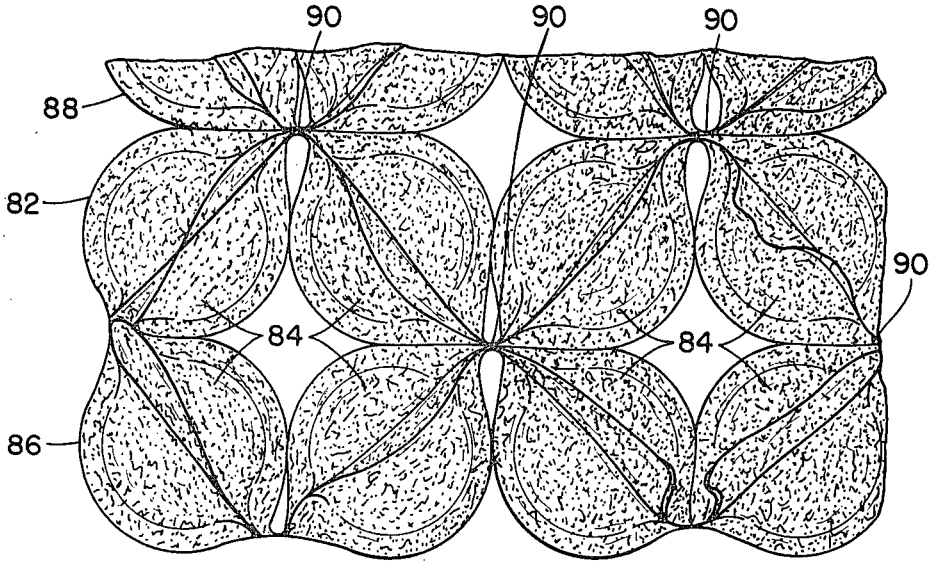
FIG. 7 is an enlarged plan view of a corner face of a rectangular pocketed spring assembly, with the springs disposed in non-nested square array.
Figure 8:
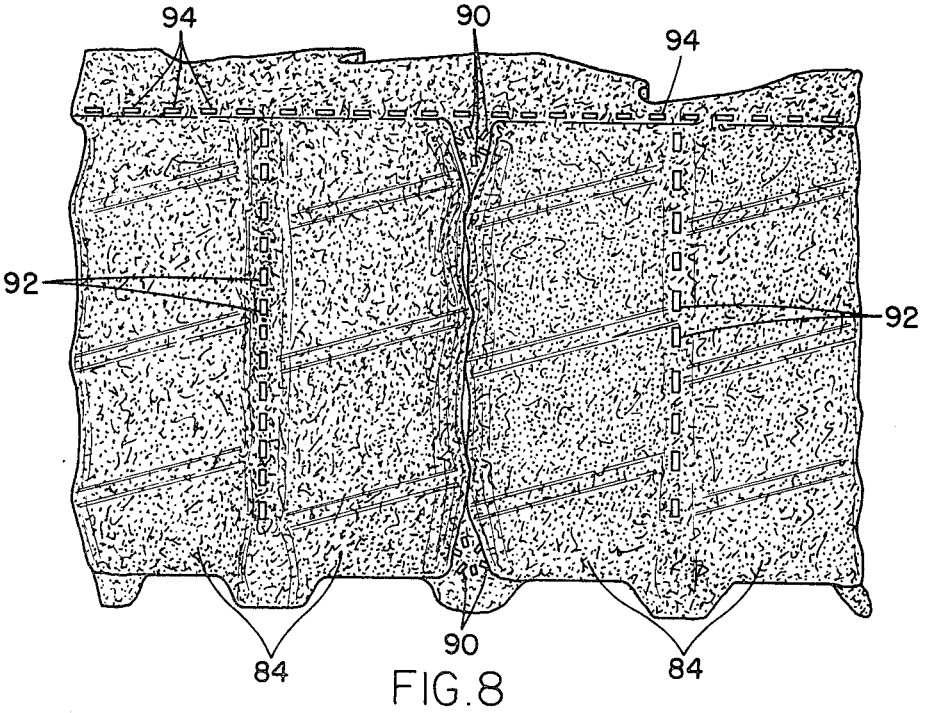
FIG. 8 is a fragmentary elevational view of the assembly of FIG. 7.

In greater detail, in the Stumpf construction which is illustrated in FIGS. 7 and 8, a pocketed spring assembly has a given strip 83 of pocketed springs 84 connected to each adjacent strip 86 and 88 by connecting the two fabric strips together. Although the overall pattern of the assembly may tend to confuse the eye, reference should be made initially to the fragmentary enlargements of FIGS. 7 and 8, from which it is more readily apparent that the connections 90 of a given strip of springs to its neighboring strip are made between a pair of successive springs 84 of each strip, and are alternated along any given strip, e.g., strip 82, so that the given strip is connected first to the neighboring strip on one side, e.g., strip 86, and then to the neighboring strip on the opposite side, e.g., strip 88, and so forth, along the entire given strip from one end or side of the assembly to the other.

The interstrip connections 90 are conveniently, although not necessarily, made near the opposite faces of the spring assembly, where, because of the preferred barrel shape of the coil, the slack of the fabric between successive pockets near the ends of the coils facilitates the insertion of a tool appropriate to make the connection.

As a result of the connection, the pair of coils of each strip immediately adjacent to the interstrip connection 90 are joined with an opposing pair in a configuration which, in plan, resembles a four-leaf clover, each spring pocket being rotated approximately one-eight turn away from the longitudinal axis of its own strip.

The strips of pocketed coils 88 chosen to illustrate the invention are produced commercially, and comprise a folded two-ply strip of non-woven fabric of thermoplastic fibers in which the spring pockets are defined between the plies by transverse lines 92 of discrete thermal welds of the plies to one another, and in which the pockets formed in the two-ply strip are closed by a longitudinal seam 94 of similar thermal welds to confine the springs in the pockets. When the springs are permitted to expand after being confined within the pockets, they impose their shapes upon the confining pocket walls in the mid-height of the pockets and produce a ruffle in the flaps of the closing seam, and at the opposite non-seamed end of the spring pocket as well, as the separation of the plies by the expanded spring foreshortens the cloth strip. This results in a slack reach of fabric along the interpocket seam 92 at each end thereof, an effect accentuated somewhat by the barrel shape of the coils 84 with which the invention is specifically illustrated.

The divergence of adjacent spring coils 84 at their ends resulting from the barrel shape provides convenient access to the strip material which, in the illustrated instance is welded to the material of the adjacent strip in the corresponding reaches of fabric between two successive coils of each strip, so that in the presently preferred and illustrated form, the adjacent strips are connected together, as at 90 near the tops and bottoms of the coils, but preferably interiorly of the end convolutions thereof.

The assembly of springs by connecting the strips together, rather than by connecting the springs, as such to one another, permits each spring to maintain a considerable degree of individual action before requiring the depression of its neighbors in the clover leaf array, and yet, beyond that point, as in areas of concentrated load under the proportionally heavier parts of the body, or when the spring assembly is highly loaded as by bearing the weight of the occupant in sitting position, the clover leaf connection of four springs together in a closely knit group associates them cooperatively so that each can assist the other to regain the full unloaded height permitted by the confining pocket when the concentrated load is subsequently removed.

The pocket material of the preferred assembly is a thermoplastic sheeting, preferably of fibrous material whether or not of continuous filament or staple fiber length, and whether spun and woven, or laid as a non-woven fabric. When the constituent material is thermoplastic, as indicated, the joining technique employed in making the assembly, as well as making the pocketed spring strip itself, may be thermal welding, a localized or spot attachment of adjacent strips being made at or near the end convolutions of the springs along the seam between the adjacent pockets in that relatively slack reach of the pocket material provided by the diverging outlines of the barrel-shaped spring coils resulting from the smaller diameter of their respective end convolutions. These connections can readily be made with available welding equipment, and do not appear to interfere materially with compression of the springs individually throughout a substantial portion of their respective heights.

Based upon the considerable history of manufacture of pocketed spring coil assemblies wherein the pocket materials were of spun and woven staple fibers of natural origin, the specific mode of attachment of adjacent strips to one another in accordance with the construction may be something specifically different from thermal welding, the ultimate objective being the secure, reliable, and non-destructive attachment of the adjacent strips to one another. This may, for example, take the form of stitching, or twine ties, or metal fasteners such as hogrings, staples, or the like, or an adhesive capable of adequately penetrating the four plies of a textile fabric with or without heat and pressure.

The peripheral frame structure may consist of non-nested pocketed upholstery springs assembled into the so-called Marshall construction as described in Stumpf U.S. Pat. No. 4,234,983, assigned to the Simmons Company, the disclosure of which is also incorporated herein by reference. In this instance the pockets with the individual coil springs are formed between overlaid plies of a two-ply strip of material by lines of separate individual welds which interconnect the plies. These welds between the material plies may be effected in an ultrasonic method and arrangement.

Figure 9:
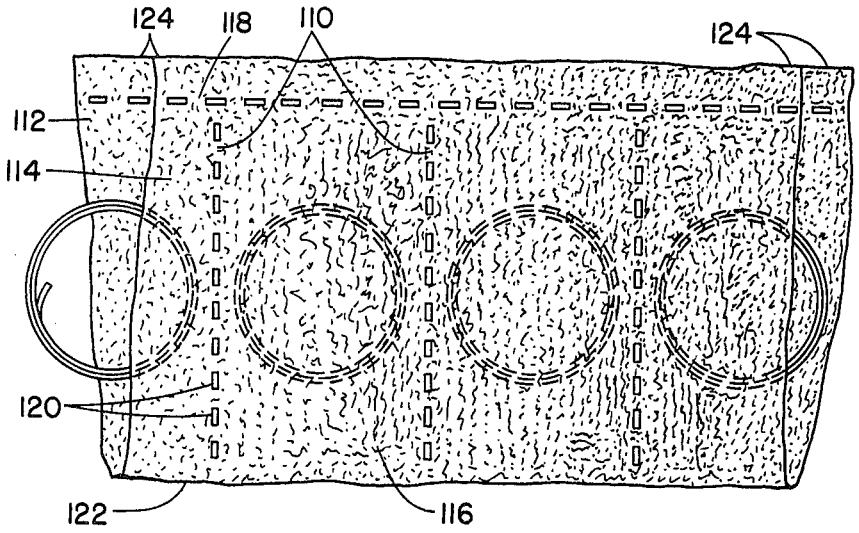
FIG. 9 is an enlarged plan view of a series of pocketed springs of the so-called Marshall construction.
Figure 10:
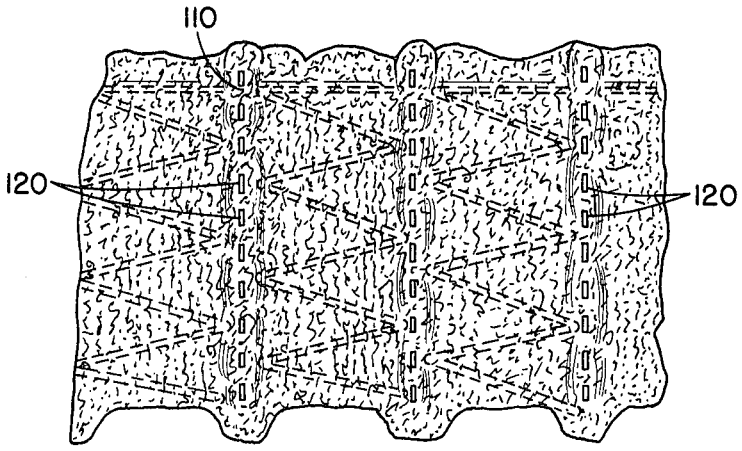
FIG. 10 is a fragmentary elevational view of the springs of FIG. 9.

In greater detail and as illustrated in FIGS. 9 and 10, the transverse lines of attachment 110 of the overlaid plies 112 and 114 of the strip 116 to each other to define the spring pockets, as well as the line 118 of the attachment which closes the pockets along the side edges of the plies between which the spring was inserted, are formed of discrete individual welds 120 rather than as a continuous weld. It will also be observed that, as illustrated, the individual welds 120 are spaced apart within the line by a distance approximately equal to the length of the individual welds along the line, and further, that the welds at each end of the transverse lines 110 of welds between the pockets do not intercept either the folded edge 122 of the fabric strip 16 or its overlaid edges 124 between which the spring was inserted.

With an interrupted line of thermal welds and using non-woven polypropylene fabric earlier referred to, a line of interrupted welds each a quarter-inch long and approximatley one-eigth inch wide and separated from each other by approximately one-quarter inch in the line, exhibits over forty percent (40%) greater resistance to separation of the pocket-forming plies than the identical material sewed on production equipment for the manufacture of pocketed springs by the conventional stitching method, using thread which is conventional for the single-thread interpocket stitching, viz., Number 30-3 soft cotton.

While thermal welding in the prescribed pattern may be achieved in a variety of ways, including contact heating and high frequency welding, the ultrasonic welding technique appears to be especially suitable in that the internal induction of heat by its mechanical working of the material is faster than contact heating, and more controllable as well as less dangerous than high-frequency electrostatic methods. Moreover, within limits, any desired pattern of welding can be achieved ultrasonically in this context by suitable modification of the anvil against which the material to be welded is pressed by the welding horn.

The outer peripheral frame structure 12 may also be constructed of rigid plastic material components and of foamed plastic cushioning material in lieu of the springs or in combination therewith.

The inner mattress core may be covered with a suitable covering material on all sides thereof such as mattress ticking. When the core is constituted of pocketed coil springs, they may be covered by a muslin forming the pocket fabric which, in turn, may comprise the covering material of the mattress core. The inner mattress core may also have a structure or physical characteristic in conformance with the needs of the user or purchaser of the mattress. For example, the core 22 may be formed of a coil spring arrangement including border wires; or may be constructed of non-nested pocketed coil springs pursuant to either Stumpf U.S. Pat. Nos. 4,234,983 or 4,234,984; or may incorporate a flotation or waterbed mattress center as shown in Callaway U.S. Pat. No. 4,245,363; or may have a pneumatic or foam filled core construction.

In certain instances, so as to impart to the mattress arrangement a still fuller and more luxurient look, a unitary piece of foamed material or sponge-like rubber material may be unserted in the cavity beneath the mattress core. This will cause the center position of the mattress to arc upwardly into a dome appearance, generally referred to as loft, thereby creating an especially attractive and expensive appearing mattress.

Referring back to the embodiment of FIG. 1, a heating unit 28 in the form of a rectangular heating pad has a fastener track 30 provided around its peripheral edge. A corresponding fastener track 32 is provided along the lower surface of pillow top 12 near its peripheral edge such that the heating pad may be removably affixed or fastened to and form a part of pillow top 12, or may be removed therefrom for maintenance or warranty work, or may be removed for safety reasons, or may be removed during the summer months, or can be replaced with an entirely new unit. In alternative embodiments, the heating pad may be fastened to other areas of the pillow top, such as its top surface, or incorporated within the lamina of the pillow top, or the heating pad may be simply retained in place under the fastened pillow top without a direct attachment thereto. The construction of heating unit 28 may be similar to that of electrical heating blankets or comforters in which a grid or array of electrical resistance conductors are woven or incorporated throughout the construction of the heating pad, or may take any suitable alternative construction.

Figure 3:
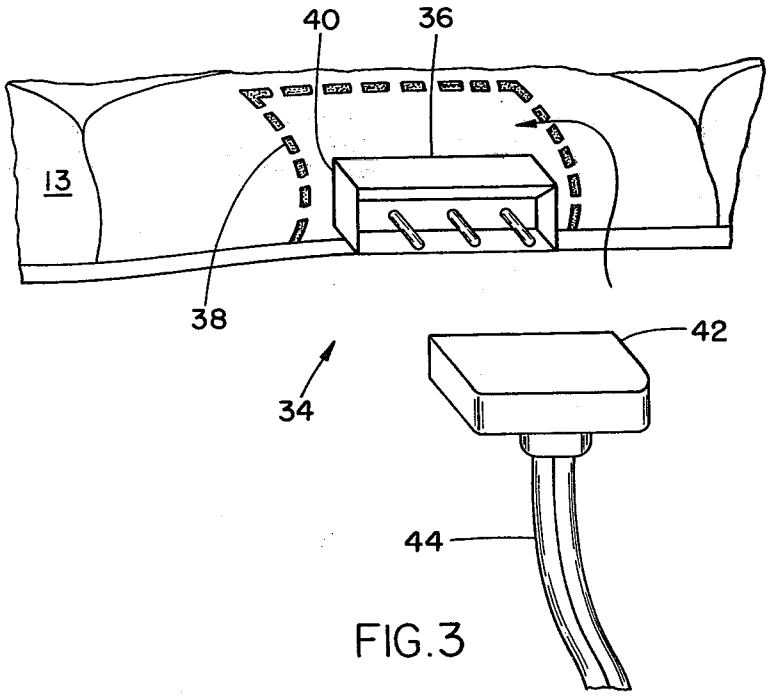
FIG. 3 illustrates one embodiment of an electrical connector between an electrical heating pad and an electrical cord leading to a heat control unit.

FIG. 3 illustrates one suitable embodiment of an electrical connector 34 to the heating unit 28 of FIG. 1. A male plug connector 36 is attached to the edge of pillow top 12, preferably centrally positioned with respect to the heating area covered by the heating unit 28. The area around the connector 36 may be suitably reinforced as at 38 to provide a sturdy construction. Connector 36 may be directly connected to heating unit 28 such that is is removably positioned within a suitable aperture 40 in quilt top 13. Alternatively, connector 36 can be detachably connected to heating unit 28 such as by an additional snap electrical connector between element 26 and the heating unit. A female plug connector 42 is also provided and is adapted to electrically couple with male connector 36.

Connector 42 leads through an electrical cord 44 to a heat control unit 46, which may take any known type construction as are known in the electrical heating blanket arts such as a rheostat type of control. Control unit 46 can have coded buttons 48 to control the heat generated in various areas of the mattress, and also can have a heat intensity switch 50 which controls the electrical power transferred to heating unit 28. A separate control unit 46 can be supplied for each half of a double or larger mattress, as illustrated in FIG. 1, or alternatively only one control unit can control heating of the entire mattress area. A further electrical power cord 52 leads to a standard male plug connector 54 which can be plugged into a suitable wall outlet.

Figure 5:
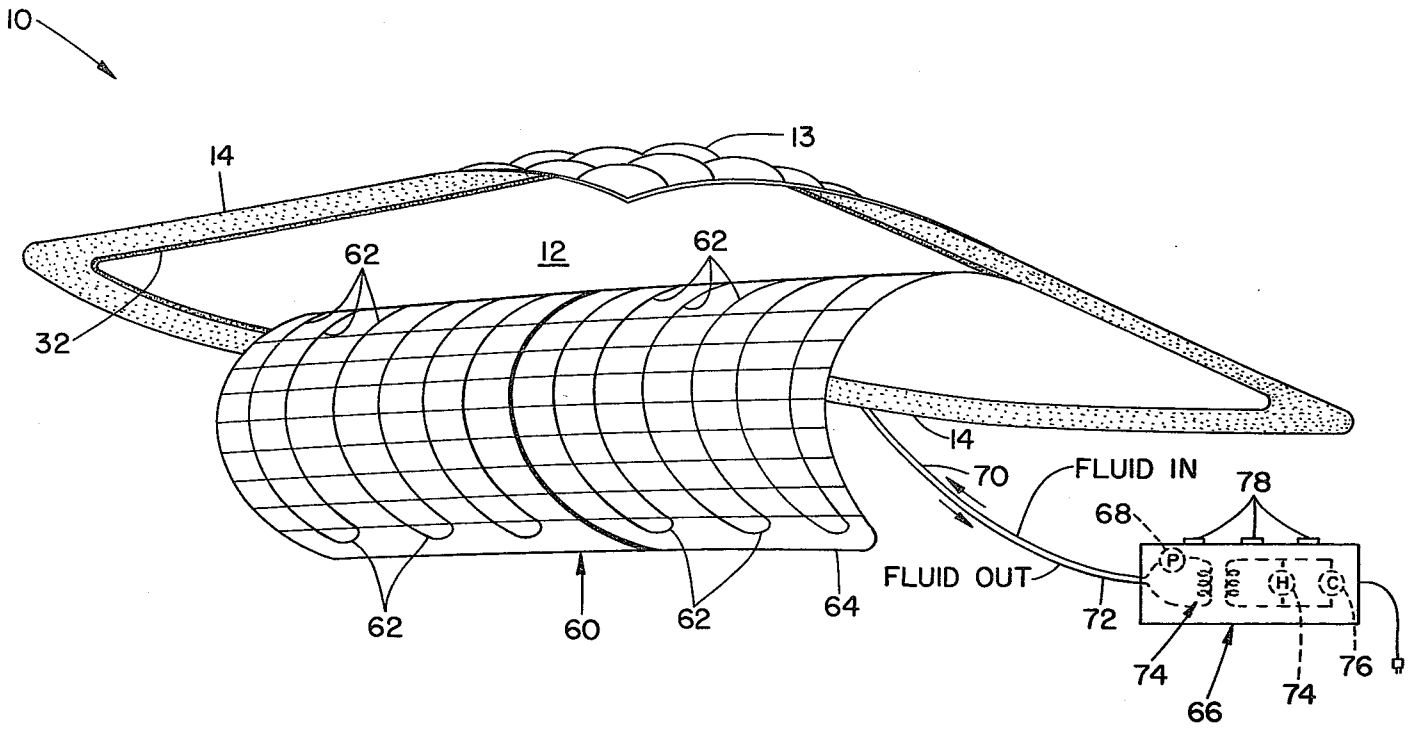
FIG. 5 is an illustration of a pillow top having a liner with an array of tubing therein, through which a heated or cooled fluid is circulated.

FIG. 5 illustrates an embodiment wherein a climate control component 60 fastens onto a surface of pillow top 12 and has incorporated therein an array of tubing 62 through which a heated fluid, such as air or water, is circulated. In these embodiments the fluid may be heated by an external unit or may be heated by a unit constructed as an integral part of the mattress. These embodiments also have an advantage that in warm weather the circulated fluid may be cooled rather than heated, thus presenting a very versatile thermally controlled mattress.

In greater particularity, tubing 62 may be a soft polymer tubing such as neoprene tubing which is fastened into a liner 64. An electrically operated control unit 66 has a pump 68 therein to pump a suitable fluid such as air or water through tube 70, through the array of tubing 62, through return tube 72 and then through a heat exchanger 74 in unit 66. Heat exchanger 74 includes a heat source 75 and a source of coolant 76 such that heat may be either introduced into or withdrawn from the heat exchanger, thus either cooling or warming the fluid circulating in the array of tubing 62. The controls 78 for unit 55 for the pump and heat source 74 and cooler 76 are positioned on one side of unit 66. The controls and the heating and cooling equipment can be units which have a conventional construction in the art.

While several embodiments and variations have been described in detail herein, it should be apparent that the teachings and disclosure of the present invention will suggest many other embodiments and variations to those skilled in this art. For instance, the zippers could be replaced by other suitable fasteners such as snap fasteners, and the quilted top surface 23 could also be replaced by any suitable mattress surface. The electrical heating elements, connectors and controls could also be suitably modifified in many different alternative constructions.

What is claimed is:

1. A thermally controllable heating mattress construction, comprising:

a. a mattress body designed to support a person lying on top thereof;

b. a removable pillow top formed of a quilted mattress liner being supported on said mattress body, means for removably fastening said pillow top to said mattress body along the peripheral edges thereof; and c. a thermal control heating unit including an electrical heating pad liner generally in conformance with the surface of said pillow top, said heating pad liner being removably interposed between the pillow top and mattress body to allow the temperature of the top surface of the mattress to be selectively regulated; and fastener means for removably fastening said heating pad liner to the bottom of said removable pillow top.

2. A thermally controllable mattress construction as claimed in claim 1, said pillow top being removably fastened to said mattress body by a fastener extending around the peripheral edge of said mattress body.

3. A thermally controllable mattress construction as claimed in claim 2, said fastener means fastening said climate control unit to the bottom of said removable pillow top along the lower peripheral edge of said pillow top.

4. A thermally controllable mattress construction as claimed in claim 1, said electrical heating pad liner comprising two separately controllable heaters, one for each half side of the mattress.

5. A thermally controllable mattress construction as claimed in claim 1 or 2 or 4, said mattress body including two separable components, an outer peripheral section, and at least one central core unit, whereby different core units can be placed in said outer peripheral section to provide a desired type of mattress construction.

* * * * *

UNITED STATES PATENT AND TRADEMARK OFFICE

CERTIFICATE OF CORRECTION

PATENT NO. : 4,423,308

DATED : December 27, 1983

INVENTOR(S) : Milton A. Callaway, et al.

It is certified that error appears in the above-identified patent and that said Letters Patent are hereby corrected as shown below:

Column 5, line 32, "strip 83" should be --strip 82--;

Column 8, line 6, "unserted" should be --inserted--;

Column 8, line 45, "element 26" should be --element 36--;

Column 9, line 16, "unit 55" should be --unit 66--;

Column 9, line 26, "surface 23" should be --surface 13--;

Signed and Sealed this

*Fifteenth* Day of *May 1984*

[SEAL]

*Attest:*

GERALD J. MOSSINGHOFF

*Attesting Officer*

*Commissioner of Patents and Trademarks*